US007279880B2

(12) United States Patent
Finney

(10) Patent No.: US 7,279,880 B2
(45) Date of Patent: Oct. 9, 2007

(54) TEMPERATURE INDEPENDENT LOW VOLTAGE REFERENCE CIRCUIT

(75) Inventor: Adrian Finney, Oldham (GB)

(73) Assignee: Zetex PLC, Chadderton, Oldham (GB)

( * ) Notice: Subject to any disclaimer, the term of this patent is extended or adjusted under 35 U.S.C. 154(b) by 623 days.

(21) Appl. No.: 10/909,169

(22) Filed: Jul. 29, 2004

(65) Prior Publication Data

US 2007/0182400 A1 Aug. 9, 2007

(51) Int. Cl.
*G05F 3/16* (2006.01)

(52) U.S. Cl. ..... 323/313; 323/315

(58) Field of Classification Search ..... 323/313, 323/314, 315

See application file for complete search history.

(56) References Cited

U.S. PATENT DOCUMENTS

| | | | | |
|---|---|---|---|---|
| 4,472,675 | A | 9/1984 | Shinomiya | 323/314 |
| 4,789,819 | A * | 12/1988 | Nelson | 323/314 |
| 5,563,502 | A | 10/1996 | Akioka et al. | 323/313 |
| 6,507,179 | B1 * | 1/2003 | Jun et al. | 323/313 |
| 6,507,180 | B2 * | 1/2003 | Eguchi | 323/314 |

FOREIGN PATENT DOCUMENTS

| | | |
|---|---|---|
| EP | 0573240 | 12/1993 |
| GB | 2298724 | 9/1996 |

* cited by examiner

*Primary Examiner*—Jessica Han
(74) *Attorney, Agent, or Firm*—Koppel, Patrick, Heybl & Dawson; Michael J. Ram

(57) ABSTRACT

A temperature independent low voltage reference circuit comprises a first transistor with a threshold voltage Vth having a negative temperature coefficient. A diode having a forward voltage drop with a negative temperature coefficient coupled with its anode connected to the drain of the first transistor and its cathode connected to the gate of the first transistor. A first resistor coupled between a power supply terminal and the drain of the first transistor. A low voltage supply terminal connected to the source of the first transistor. A second resistor coupled between the gate of the first transistor and the low voltage supply terminal. The drain of the first transistor provides a voltage with a negative temperature coefficient equal to the sum of the forward voltage drop across the diode and the threshold voltage of the first transistor. A circuit providing a voltage with a positive temperature coefficient is coupled between the drain of the first transistor and the low voltage supply terminal and has an output terminal. The positive temperature coefficient balances said negative temperature coefficient so that the voltage at said output has a temperature coefficient of zero.

8 Claims, 1 Drawing Sheet

TEMPERATURE INDEPENDENT LOW VOLTAGE REFERENCE CIRCUIT

RELATED APPLICATIONS

This application is related to, and claims priority from British Patent Application No. 0317891.0, entitled A Temperature Independent Low Voltage Reference Circuit, filed on Jul. 31, 2003, which is fully incorporated herein by reference.

The present invention relates to a temperature independent low voltage reference circuit.

Many electrical circuits require an internally derived temperature independent low voltage reference. One form of temperature independent low voltage reference may be a band gap reference circuit. Such a circuit involves the generation of a circuit with a positive temperature coefficient the same as the negative temperature coefficient of $V_{BE}$, the base emitter voltage, of a bipolar transistor. When the two are added together the resultant voltage has a temperature coefficient of zero.

A band gap reference circuit is implemented using bipolar transistors and is very common. However, reliance on a bipolar transistor can be disadvantage in many applications. For example, there are many instances of integrated circuits based on MOSFETS and other simple components such as resistors and diodes, which have fabrication processes that do not lend themselves to the practical inclusion of bipolar structures.

It is an object of the present invention to obviate or mitigate the above disadvantages.

According to a first aspect of the present invention there is provided a temperature independent low voltage reference circuit comprising:

a first transistor with a threshold voltage Vth having a negative temperature coefficient;

a diode having a forward voltage drop with a negative temperature coefficient coupled with its anode connected to the drain of the first transistor and its cathode connected to the gate of the first transistor;

a power supply terminal;

a first resistor coupled between the power supply terminal and the drain of the first transistor;

a low voltage supply terminal connected to the source of the first transistor;

a second resistor coupled between the gate of the first transistor and the low voltage supply terminal;

the drain of the first transistor providing a voltage with a negative temperature coefficient equal to the sum of the forward voltage drop across the diode and the threshold voltage of the first transistor; and a circuit providing a voltage with a positive temperature coefficient coupled between the drain of the first transistor and the low voltage supply terminal and having an output terminal;

wherein, said positive temperature coefficient balances said negative temperature coefficient so that the voltage at said output has a temperature coefficient of zero.

According to a second aspect of the present invention there is provided a temperature independent low voltage reference circuit comprising:

a circuit providing a voltage with a negative temperature coefficient coupled between a power supply terminal and a low voltage supply terminal;

an active current mirror comprising:

second and third transistors with their gates connected together, their sources connected to the low voltage supply, the drain of the second transistor being connected to the gate of the second transistor, the drain of the third transistor being connected to said output terminal;

a third resistor connected between the output of the circuit providing a voltage with a negative temperature coefficient and the drain of the second transistor; and a fourth resistor connected between the output of said circuit providing a voltage with a negative temperature coefficient and the drain of the third transistor;

wherein the active current mirror provides a voltage with a positive temperature coefficient, which balances said negative temperature coefficient such that the voltage at said output terminal has a temperature coefficient of zero.

Preferably the circuits according to the first and second aspects of the present invention are combined in a single circuit.

The present invention is designed such that it may be integrated into a circuit utilising a smart MOSFET fabrication process where only MOSFETs, diodes and resistors are used resulting in a low mask count. This low mask count provides cost savings over other integrated circuit types.

Other objects and advantages of the various aspects of the present invention will become apparent from the following description.

Specific embodiments of the present invention will now be described, by way of example only, with reference to the accompanying drawings, in which.

Figure 1:
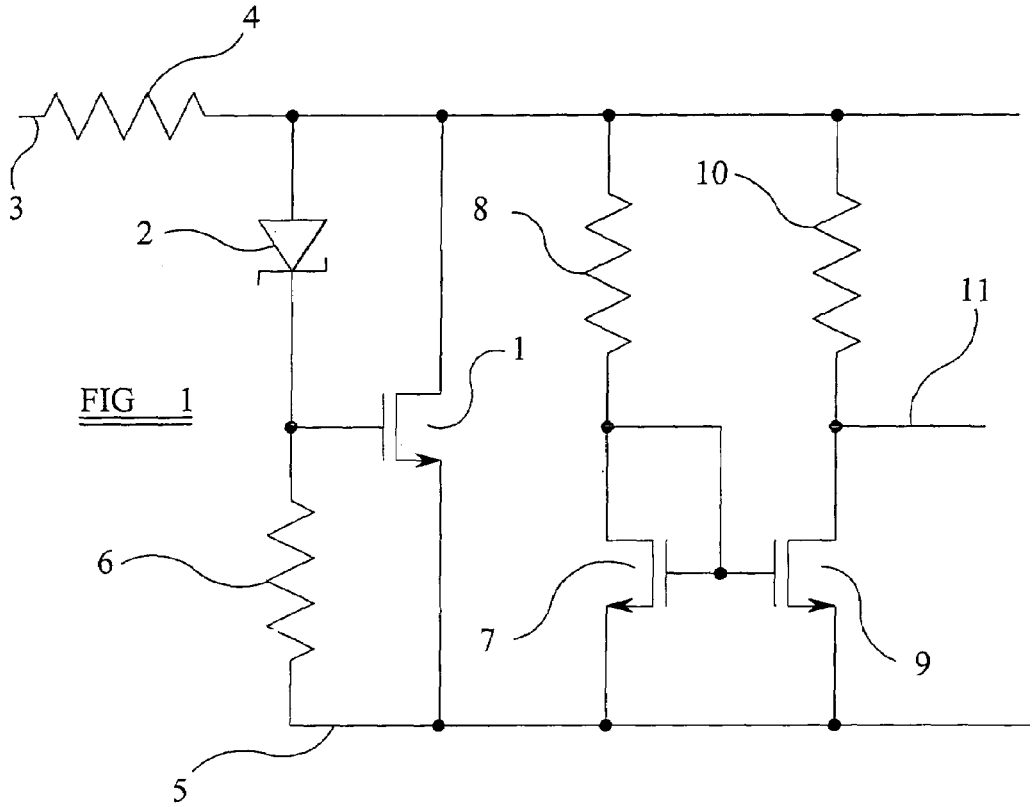
FIG. 1 illustrates a temperature independent low voltage reference circuit in accordance with the present invention.

Referring first to FIG. 1, this shows a temperature independent low voltage reference circuit in accordance with the present invention. The illustrated circuit comprises a first transistor 1, a diode 2, a supply voltage 3 (which may be unregulated), a first resistor 4, a low voltage supply rail 5 (typically ground), a second resistor 6, a current mirror further comprising transistors 7 and 9 together with resistors 8 and 10 and an output terminal 11.

The circuit is fed by the supply voltage 3, which causes current to flow through resistor 4, diode 2 and resistor 6, which are connected in series between the supply voltage 3 and the low voltage rail 5. The supply voltage 3 is positive with respect to the low voltage rail 5. The diode 2 is forward biased thus allowing current to flow.

Transistor 1 is coupled between the junction of resistor 4 and diode 2 and the low voltage rail 5. That is, the drain of transistor 1 is connected to the junction of resistor 4 and diode 2 and the source is connected to the low voltage rail 5. The gate contact of transistor 1 is connected to the junction between diode 2 and resistor 6.

The current mirror comprises transistors 7 and 9 together with resistors 8 and 10. Transistor 7 is a control transistor having its gate connected to its drain and its source connected to the low voltage rail 5. Resistor 8 is coupled between the drain of the transistor 1 and the drain/gate of control transistor 7. Transistor 9 is connected back to back with control transistor 7, i.e. the gates of transistors 7 and 9 are connected. The source of transistor 9 is connected to the low voltage rail 5. Resistor 10 is coupled between the drain of the transistor 1 and the drain of transistor 9. The output terminal 11 is connected to the drain of transistor 9.

Operation of the circuit will now be described:

The power for the circuit is provided by the supply voltage 3. The voltage at the drain of transistor 1 is fixed with respect to the low voltage rail 5 of the circuit such that it varies approximately linearly with changes of temperature in the circuit, with no regard to the voltage level of the supply voltage 3 (assuming this remains higher than the voltage at the voltage at the drain of transistor 1 such that diode 2 remains forward biased). The function of resistor 4 is to accommodate the voltage drop between the unregulated supply voltage 3 and the drain of transistor 1.

The voltage at the drain of transistor 1 is the sum of the voltage drop across the diode 2 (Vf) plus the threshold voltage for transistor 1 (Vth). Both Vf and Vth have a negative temperature coefficient (i.e. they reduce with increasing temperature) therefore the voltage at the drain of transistor 1 Vf+Vth has a negative temperature coefficient.

Figure 2:
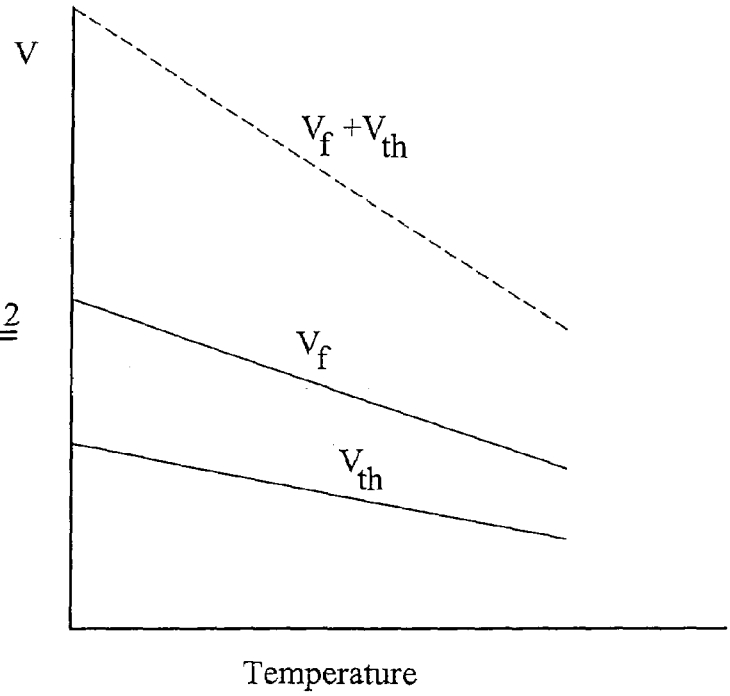
FIG. 2 is a graph showing the variation of voltage with temperature of components of the circuits of FIG. 1.

FIG. 2 shows the relationship between temperature and voltage for Vf, Vth and Vf+Vth. Resistor 6 allows a current to flow through diode 2, (and thus create the voltage drop Vf). The magnitude of this current is fixed by its resistance and the voltage applied across it Vth, which is the result of it bridging the gate and the source of transistor 1.

Collectively resistor 4, diode 2, resistor 6 and transistor 1 therefore function as a temperature sensor deriving a temperature dependent voltage at the drain of transistor 1 (with respect to the low voltage rail 5) from the supply voltage 3.

The effect of control transistor 7 in series with resistor 8 is that there is a broadly constant voltage drop across transistor 7, therefore for a given level of the voltage at the drain of transistor 1 a broadly constant current flows through resistor 8, (determined by the size of the resistance 8), and transistor 7. This current is mirrored through resistor 10 and transistor 9, in a proportion dependent on the relative sizes of transistors 7 and 9 and ratios of resistors 8 and 10. This magnified or reduced current gives rise to a predetermined voltage drop across resistor 10, (again for a given value of the voltage at the drain of transistor 1), from the drain of transistor 1. The voltage at the drain of transistor 9 is connected to the output terminal to provide the temperature dependent output.

In a transistor with increasing temperature a reducing Vth is offset by an increasing on resistance (RDSON) giving rise to a temperature independent component of the device current. The total device current is the sum of a number of separate device currents and thus may be temperature independent, or have a negative or positive temperature coefficient. By the appropriate dimensioning of the elements within this current mirror, resistors 8 and 10 and transistors 7 and 9 a desired temperature coefficient at the output of the current mirror can be obtained.

If the current passing through resistor 10 and transistor 9 is configured to have a negative temperature coefficient then given a constant resistance the voltage drop across resistor 10 will have a negative coefficient. The effect of this is to cause the output of the current mirror, (the voltage at the drain of transistor 1 minus the voltage drop across resistor 10), to be a voltage with a less negative temperature coefficient than the voltage at the drain of transistor 1.

The components of the current mirror are selected so that the current mirror has a positive temperature coefficient which cancels the negative coefficient of the voltage at the drain of transistor 1 to thereby provide a voltage at the output of the current mirror that is independent of temperature (equivalent to a temperature coefficient of zero).

As described above this constant, temperature independent voltage source is created from a supply voltage 3 (which may be unregulated) through the careful dimensioning of components to trade off positive and negative temperature coefficients. This circuit can operate at a very low voltage, (down to Vth+Vf) making a very low voltage regulator without the need for bipolar transistors, and suitable for incorporation in an integrated circuit comprising solely NMOS transistors, diodes and resistors. Thus, this circuit may be incorporated within low cost, low mask count integrated circuits as it does not involve the use of bipolar transistors as with the normal band gap reference voltage approach.

Further possible modifications and applications of the present invention will be readily apparent to the appropriately skilled person. For example a Widlar current mirror may prove useful in avoiding very large differences in resistor values for resistors 8 and 10, which may otherwise have been necessary due to the desired regulated voltage, and which are difficult to fabricate.

The invention claimed is:

1. A temperature independent low voltage reference circuit comprising:

a first transistor with a threshold voltage Vth having a negative temperature coefficient;

a diode having a forward voltage drop with a negative temperature coefficient coupled with its anode connected to the drain of the first transistor and its cathode connected to the gate of the first transistor;

a power supply terminal;

a first resistor coupled between the power supply terminal and the drain of the first transistor;

a low voltage supply terminal connected to the source of the first transistor;

a second resistor coupled between the gate of the first transistor and the low voltage supply terminal;

the drain of the first transistor providing a voltage with a negative temperature coefficient equal to the sum of the forward voltage drop across the diode and the threshold voltage of the first transistor; and a circuit providing a voltage with a positive temperature coefficient coupled between the drain of the first transistor and the low voltage supply terminal and having an output terminal;

wherein, said positive temperature coefficient balances said negative temperature coefficient so that the voltage at said output has a temperature coefficient of zero.

2. A temperature independent low voltage reference circuit according to claim 1, wherein said circuit providing a voltage with a positive temperature coefficient comprises MOSFETs and passive components.

3. A temperature independent low voltage reference circuit according to claim 2, wherein said circuit providing a voltage with a positive temperature coefficient comprises:

an active current mirror comprising:

second and third transistors with their gates connected together, their sources connected to the low voltage supply, the drain of the second transistor being connected to the gate of the second transistor, the drain of the third transistor being connected to said output terminal;

a third resistor connected between the drain of the first transistor and the drain of the second transistor; and a fourth resistor connected between the drain of the first transistor and the drain of the third transistor;

wherein the active current mirror provides said voltage with a positive temperature coefficient at the drain of the third transistor.

4. A temperature independent low voltage reference circuit according to claim 3, wherein said circuit comprises solely MOSFETs and passive components.

5. A temperature independent low voltage reference circuit comprising:

a circuit providing a voltage with a negative temperature coefficient coupled between a power supply terminal and a low voltage supply terminal;

an active current mirror comprising:

second and third transistors with their gates connected together, their sources connected to the low voltage supply, the drain of the second transistor being connected to the gate of the second transistor, the drain of the third transistor being connected to said output terminal;

a third resistor connected between the output of the circuit providing a voltage with a negative temperature coefficient and the drain of the second transistor; and a fourth resistor connected between the output of said circuit providing a voltage with a negative temperature coefficient and the drain of the third transistor;

wherein the active current mirror provides a voltage with a positive temperature coefficient, which balances said negative temperature coefficient such that the voltage at said output terminal has a temperature coefficient of zero.

6. A temperature independent low voltage reference circuit according to claim 5, wherein said circuit providing a voltage with a negative temperature coefficient comprises MOSFETs and passive components.

7. A temperature independent low voltage reference circuit according to claim 6, wherein said circuit providing a voltage with a negative temperature coefficient comprises:

a first transistor with a threshold voltage Vth having a negative temperature coefficient, with its source connected to the low voltage supply terminal;

a diode having a forward voltage drop with a negative temperature coefficient coupled with its anode connected to the drain of the first transistor and its cathode connected to the gate of the first transistor;

a first resistor coupled between the power supply terminal and the drain of the first transistor; and a second resistor coupled between the gate of the first transistor and the low voltage supply terminal, wherein the drain of the first transistor provides a voltage with a negative temperature coefficient equal to the sum of the forward voltage drop across the diode and the threshold voltage of the first transistor.

8. A temperature independent low voltage reference circuit according to claim 6, wherein said circuit comprises solely MOSFETs and passive components.

* * * * *